US011698201B2

(12) United States Patent
Li

(10) Patent No.: US 11,698,201 B2
(45) Date of Patent: Jul. 11, 2023

(54) PURIFICATION DEHUMIDIFIER

(71) Applicants: GD MIDEA AIR-CONDITIONING EQUIPMENT CO., LTD., Foshan (CN); MIDEA GROUP CO., LTD., Foshan (CN)

(72) Inventor: Weiming Li, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 166 days.

(21) Appl. No.: 16/792,222

(22) Filed: Feb. 15, 2020

(65) Prior Publication Data

US 2020/0182490 A1 Jun. 11, 2020

Related U.S. Application Data

(63) Continuation of application No. PCT/CN2017/117839, filed on Dec. 21, 2017.

(30) Foreign Application Priority Data

Sep. 13, 2017 (CN) ..... 201710826777.7
Sep. 13, 2017 (CN) ..... 201710826779.6

(51) Int. Cl.
*F24F 1/0358* (2019.01)
*F24F 1/035* (2019.01)
(Continued)

(52) U.S. Cl.
CPC ..... *F24F 8/80* (2021.01); *F24F 1/0287* (2019.02); *F24F 1/035* (2019.02); *F24F 1/0358* (2019.02);
(Continued)

(58) Field of Classification Search
CPC ..... F24F 1/0358; F24F 1/035; F24F 1/0287; F24F 13/1426; F24F 13/222;
(Continued)

(56) References Cited

U.S. PATENT DOCUMENTS 5,901,565 A * 5/1999 Morton, Jr. ..... F24F 3/1405 165/227
2006/0054712 A1* 3/2006 Wu ..... F24F 13/30 236/44 A
(Continued)

FOREIGN PATENT DOCUMENTS

CN 102186553 A 9/2011
CN 102788388 A 11/2012
(Continued)

OTHER PUBLICATIONS

World Intellectual Property Organization (WIPO) Written Opinion for PCT/CN2017/117839 with translation dated Jun. 7, 2018 7 Pages.
(Continued)

*Primary Examiner* — Frantz F Jules
*Assistant Examiner* — Martha Tadesse
(74) *Attorney, Agent, or Firm* — Anova Law Group PLLC

(57) ABSTRACT

A purification dehumidifier includes a housing, a fan, a dehumidifier assembly, and a purifier assembly. The housing includes an air inlet, a dehumidified air outlet, and a purified air outlet. An air duct in communication with the air inlet, the dehumidified air outlet, and the purified air outlet is formed in the housing. The fan is arranged in the air duct and configured to introduce an airflow into the air duct from the air inlet and blow the airflow in the air duct out from at least one of the dehumidified air outlet or the purified air outlet. The dehumidifier assembly is arranged in the air duct and
(Continued)

corresponding to the dehumidified air outlet. The purifier assembly is arranged in the air duct and corresponding to the purified air outlet.

20 Claims, 6 Drawing Sheets

(51) Int. Cl.

| | |
|---|---|
| ***F24F 1/0287*** | (2019.01) |
| ***F24F 8/80*** | (2021.01) |
| ***F24F 13/14*** | (2006.01) |
| ***F24F 13/22*** | (2006.01) |
| ***F24F 8/158*** | (2021.01) |
| ***F24F 8/108*** | (2021.01) |

(52) U.S. Cl.
CPC ..... *F24F 8/108* (2021.01); *F24F 8/158* (2021.01); *F24F 13/1413* (2013.01); *F24F 13/1426* (2013.01); *F24F 13/222* (2013.01); *F24F 2013/1433* (2013.01); *F24F 2013/1446* (2013.01)

(58) Field of Classification Search
CPC ..... F24F 13/1413; F24F 2013/1433; F24F 2013/1446; F24F 2003/1446; F24F 3/14; F24F 8/158; F24F 3/16; F24F 13/30
See application file for complete search history.

(56) References Cited

U.S. PATENT DOCUMENTS

2008/0257086 A1* 10/2008 Noritake ..... H02K 7/06 74/422
2011/0072925 A1* 3/2011 Ikeda ..... F16H 19/00 74/412 R
2011/0197770 A1* 8/2011 Yun ..... F24F 1/035 55/438

FOREIGN PATENT DOCUMENTS

| | | | | | |
|---|---|---|---|---|---|
| CN | 203286674 | | * | 11/2013 | |
| CN | 203286674 | U | | 11/2013 | |
| CN | 103822317 | A | | 5/2014 | |
| CN | 105444279 | A | | 3/2016 | |
| CN | 103822317 | B | | 8/2016 | |
| JP | 2001221496 | A | * | 5/2001 | |
| JP | 2001221496 | A | | 8/2001 | |
| JP | 2010038392 | A | | 2/2010 | |
| JP | 2012167899 | A | | 9/2012 | |
| KR | 20030049937 | A | | 6/2003 | |
| KR | 20110067191 | A | | 6/2011 | |
| KR | 101440474 | B1 | | 11/2014 | |
| KR | 20150136692 | A1 | | 12/2015 | |
| WO | 2010047550 | A2 | | 4/2010 | |
| WO | 2015156636 | A1 | | 10/2015 | |
| WO | WO-2016093634 | A1 | * | 6/2016 | ..... B01D 46/00 |

OTHER PUBLICATIONS

The European Patent Office (EPO) Supplementary Search Report for EP Application No. 17924828.1 dated Aug. 4, 2020 1 Page.
The European Patent Office (EPO) Extended Search Report for EP Application No. 17924828.1 dated Jul. 16, 2020 11 Pages.
World Intellectual Property Organization (WIPO) International Search Report for PCT/CN2017/117839 dated Jun. 7, 2018 6 Pages.

* cited by examiner

PURIFICATION DEHUMIDIFIER

CROSS-REFERENCE TO RELATED APPLICATIONS

This application is a continuation of International Application No. PCT/CN2017/117839, filed Dec. 21, 2017, which claims priority to Chinese Patent Application Nos. 201710826779.6 and 201710826777.7, both filed Sep. 13, 2017, the entire contents of all of which are incorporated herein by reference.

TECHNICAL FIELD

The present disclosure relates to the technical field of air conditioning, in particular to a purification dehumidifier.

BACKGROUND

At present, for dehumidifiers on the market, a majority of typical dehumidifiers merely have dehumidifying function. Such dehumidifiers may idle most of the time except for short humid days, and utilization rate of such dehumidifiers is extremely low.

SUMMARY

The present disclosure is mainly to provide a purification dehumidifier, aiming at providing a purification dehumidifier with dehumidification and air purification functions simultaneously.

In order to achieve the above object, the purification dehumidifier provided by the present disclosure includes:

a housing, including an air inlet, a dehumidified air outlet and a purified air outlet, and an air duct in the housing in communication with the air inlet, the dehumidified air outlet and the purified air outlet;

a fan arranged in the air duct to introduce an airflow into the air duct from the air inlet and blow the airflow in the air duct out from the dehumidified air outlet and the purified air outlet;

a dehumidifier assembly, arranged in the air duct and corresponding to the dehumidified air outlet;

a purifier assembly, arranged in the air duct and corresponding to the purified air outlet.

Optionally, the purification dehumidifier further includes an air door assembly arranged in the housing and corresponding to the dehumidified air outlet and/or the purified air outlet, to open or block the dehumidified air outlet or the purified air outlet.

Optionally, the air door assembly includes at least one air door structure, and the air door assembly includes a driving member, at least two swing blades and a connection member connected with the driving member and the swing blades. The driving member is configured drive the connection member to move and drive the swing blades to rotate, to form a gap between two adjacent swing blades to open the dehumidified air outlet or the purified air outlet; or, to allow the two adjacent swing blades to abut and block the dehumidified air outlet or the purified air outlet.

Optionally, the connection member includes:

a first gear connected to the driving member;

a gear rack engaged with the first gear; and at least two second gears, and each of the second gears is engaged with the gear rack, and connected to one end of one of the swing blades; in which the driving member is configured to drive the first gear to rotate, the first gear is configured to drive the gear rack to move, the gear rack is configured to drive each of the second gears to rotate, and each of the second gears is configured to rotate to bring one of the swing blades to rotate.

Optionally, a guiding inclined surface is provided at a joint of one of the swing blades and another swing blade adjacent to the swing blade.

Optionally, the driving member is a step motor.

Optionally, the fan is a cross-flow fan.

Optionally, the cross-flow fan includes a volute and an impeller arranged in the volute, in which the volute is provided with an air inlet side and an air outlet side, the air inlet side is in communication with the air inlet, and the air outlet side is in communication with the dehumidified air outlet and the purified air outlet.

Optionally, the impeller is extended along the height direction of the housing, and the height of the air inlet is matched with the height of the impeller.

Optionally, the dehumidified air outlet and the purified air outlet are spaced in the height direction of the housing.

Optionally, the air inlet, the dehumidified air outlet and the purified air outlet are positioned along a circumferential direction of the housing.

Optionally, the dehumidifier includes an evaporator and a condenser laminated along an air out-flowing direction of the dehumidified air outlet, the evaporator is configured to cover the dehumidified air outlet.

Optionally, the dehumidifier assembly further comprises a water tank and a water receiving plate arranged in the housing, wherein the water receiving plate is positioned below the evaporator and is in communication with the water tank.

Optionally, the dehumidifier further comprises a compressor arranged in the housing and in communication with the evaporator and the condenser to form a refrigerant circulation loop.

Optionally, the purifier includes a purification filter layer covering the purified air outlet.

Optionally, the purification filter layer includes an activated carbon filter layer and a high efficiency air filter layer.

According to the technical solution of the present disclosure, the air inlet, the dehumidified air outlet and the purified air outlet are arranged on the housing of the purification dehumidifier. The dehumidifier is arranged corresponding to the dehumidified air outlet and the purifier is arranged corresponding to the purified air outlet. A part of air entering the housing from the air inlet can be dehumidified by the dehumidifier before changed into dry air and discharged from the dehumidified air outlet. The other part of air entering the housing from the air inlet can be purified by the purifier before changed into clean air and discharged from the purified air outlet. Thus dehumidification and the air purification can be achieved by the purification dehumidifier. That is, the purification dehumidifier with dehumidification and purification functions are provided.

BRIEF DESCRIPTION OF THE DRAWINGS

In order to explain the embodiment of the present application more clearly, the following will briefly introduce the drawings used in the description of the embodiments. Obviously, the drawings in the following description are only some embodiments of the present application. For those ordinary skill in the art, other drawings can be obtained according to the structure shown in these drawings without any creative effort.

DESCRIPTION OF REFERENCE NUMERALS

TABLE 1

Figure 1:
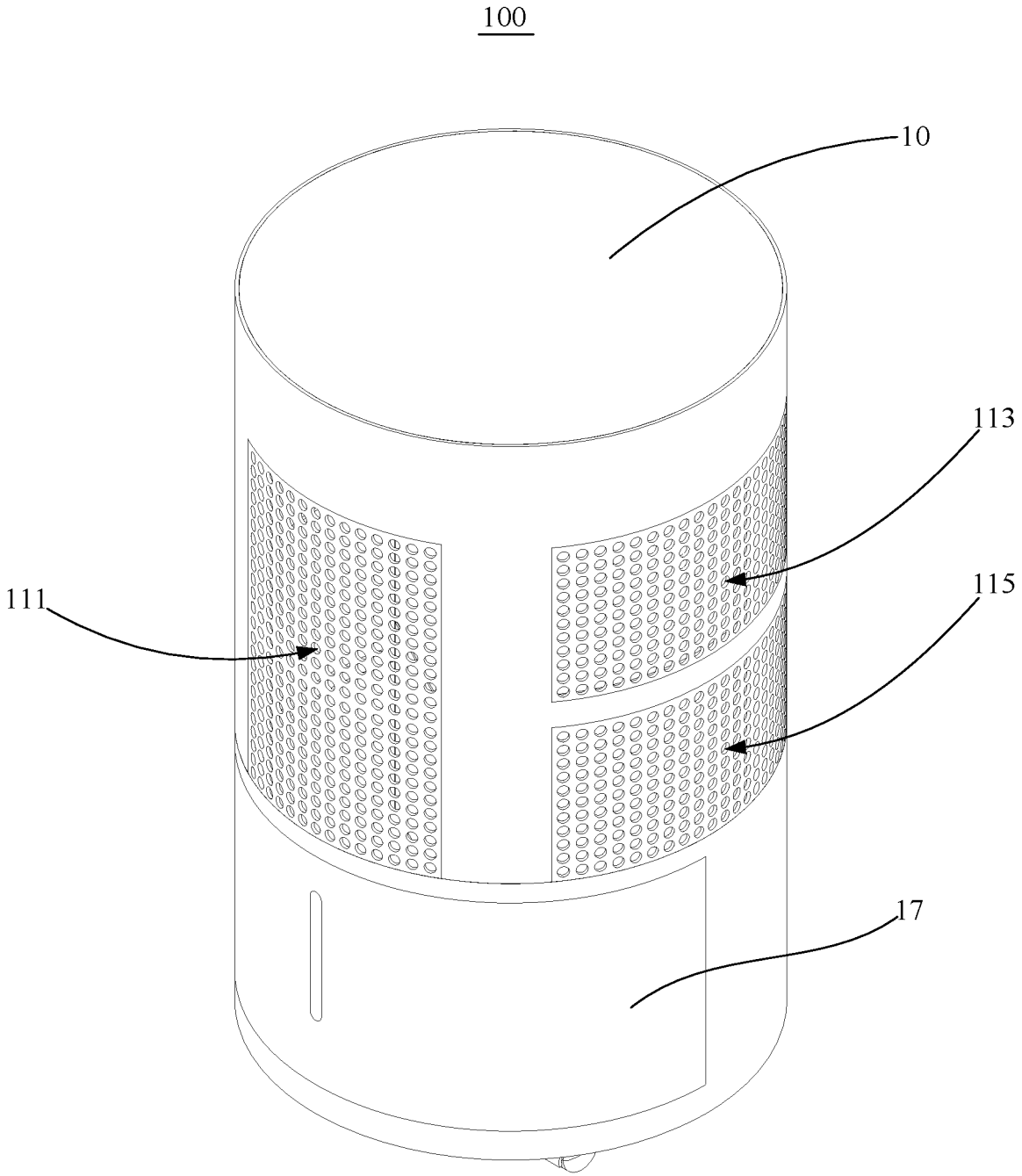
FIG. 1 is a schematic structural diagram of the purification dehumidifier according to an embodiment of the present disclosure.

| Reference Numeral | Name | Reference Numeral | Name |
|---|---|---|---|
| 100 | Purification dehumidifier | 57 | Water receiving tray |
| 10 | Housing | 59 | Water tank |
| 11 | Air duct | 70 | Air door structure |
| 111 | Air inlet | 71 | Driving member |
| 113 | Dehumidified air outlet | 73 | Connection member |
| 115 | Purified air outlet | 731 | First gear |
| 13 | Cylinder | 733 | Gear rack |
| 131 | Partition | 735 | Second gear |
| 1311 | Slide rail | 75 | Swing blade |
| 15 | End cap | 90 | Fan |
| 17 | Movable door | 91 | Volute |
| 30 | Purifier assembly | 911 | Air inlet side |
| 50 | Dehumidifier assembly | 913 | Air outlet side |
| 51 | Compressor | 93 | Impeller |
| 53 | Evaporator | 95 | Motor |
| 55 | Condenser | | |

The implementation, functional features and advantages of the present application will be further described with reference to the accompanying drawings with the embodiments.

DETAILED DESCRIPTION OF THE EMBODIMENTS

As following, the technical solution in the embodiments of the present disclosure will be described clearly with reference to the drawings of the present application. Obviously, the described embodiments are only some of the embodiments of the present application, not all of the embodiments. Based on the embodiments described in the present application, all other embodiments perceived by those with ordinary skills in the art without creative effort should fall within the scope of the present application.

It should be appreciated that all directional indications (such as upper, lower, left, right, front, rear, etc.) in the embodiments of the present application are only used to explain the relative positional relationship, movement, etc., between various components under a certain specific attitude (as shown in the drawings). If the specific attitude changes, the directional indicator will also change accordingly.

In addition, the descriptions associated with "first," "second" and the like in the present application are for descriptive purposes only and cannot be appreciated as indicating or implying its relative importance or implicitly indicating a number of technical features indicated. Thus, features associated with "first" and "second" may explicitly or implicitly include at least one of the features. In the description of the present application, the meaning of "plural" is at least two, such as two, three, etc., otherwise specifically defined.

In the present application, the terms "connected" and "fixed" etc. should be appreciated in a broad sense, unless otherwise specified and defined. For example, "fixed" can be a fixed connection, a detachable connection, or an forming a part integrally; It can be a mechanical connection or an electrical connection; It can be a direct connection or an indirect connection through an intermediate medium; and it can be the communication between interior of two elements or the interaction between two elements, unless otherwise specifically defined. For those ordinary skilled in the art, the specific meanings of the aforementioned terms in the present application can be appreciated according to practical conditions.

In addition, the technical solutions between the various embodiments may be combined with each other, as long as there is no conflict.

The present disclosure provides a purification dehumidifier 100.

Referring to FIGS. 1 to 5, in one embodiment, the purification dehumidifier 100 includes a housing 10, a fan 90, a dehumidifier assembly 50 (a dehumidifier), and a purifier assembly 30 (a purifier).

The housing 10 is provided with an air inlet 111, a dehumidified air outlet 113 and a purified air outlet 115. An air duct 11 connecting the air inlet 111, the dehumidified air outlet 113 and the purified air outlet 115 is formed in the housing 10.

The fan 90 is arranged in the air duct 11 to introduce air into the air duct 11 from the air inlet 111 and blow the air in the air duct 11 out from the dehumidified air outlet 113 and the purified air outlet 115.

The dehumidifier assembly 50 is arranged in the air duct 11 and corresponding to the dehumidified air outlet 113.

The purifier assembly 30 is arranged in the air duct 11 and corresponding to the purified air outlet 115.

In the present embodiment, the housing 10 is approximately cylindrical and an axis of the housing 10 is vertical. The air inlet 111, the dehumidified air outlet 113, and the purified air outlet 115 are all arranged on the side wall of the housing 10. Specifically, the dehumidified air outlet 113 is disposed opposite to the air inlet 111, and the purified air outlet 115 is also disposed opposite to the air inlet 111.

The dehumidifier assembly 50 includes a condenser 55, an evaporator 53, and a refrigerant circulation line. The condenser 55 and the evaporator 53 are connected to the refrigerant circulation line. The condenser 55 and the evaporator 53 are both arranged close to the dehumidified air outlet 113, and the evaporator 53 is closer to the dehumidified air outlet 113 than the condenser 55. The evaporator 53 is configured to cover the dehumidified air outlet 113. As such, the air flow entering the air duct 11 from the air inlet 111 can be blown out from the dehumidified air outlet 113 after being heated and warmed by the condenser 55 and condensed and dehumidified by the evaporator 53 in sequence, to complete a dehumidifying process. It should be appreciated that the refrigerant circulation line includes a compressor 51, a throttling device (not shown) and pipelines (not shown) for connecting various components. The compressor 51 compresses the refrigerant to form high-temperature gas. After the heat of the high-temperature gas is dissipated by the condenser 55, low-temperature liquid is formed by the throttling device. In the evaporator 53, the low-temperature liquid absorbs heat from the air and is evaporated, and then returns to the compressor 51 to complete a refrigerant circulation process.

The purifier assembly 30 includes a purification filter layer and a mounting assembly (not shown). The mounting assembly is configured to fix the purification filter layer in the housing 10 and makes the purification filter layer cover the purified air outlet 115. As such, the air flow entering the air duct 11 from the air inlet 111 can be filtered by the purification filter layer before being blown out from the purified air outlet 115 to complete the purifying process.

When the fan 90 operates regularly, the air outside the housing 10 enters the housing 10 from the air inlet 111. After circulating in the housing 10, some of the air is dehumidified by the dehumidifier assembly 50 to become dry air, and is discharged from the dehumidified air outlet 113. The other part of the air is purified by the purifier assembly 30 to become clean air, and is discharged from the purified air outlet 115. As such, the purification dehumidifier 100 simultaneously operates with dehumidification and air purification.

It should be appreciated that, according to the technical solution of the present disclosure, the air inlet 111, the dehumidified air outlet 113 and the purified air outlet 115 are arranged on the housing 10 of the purification dehumidifier 100. The dehumidifier assembly 50 is arranged corresponding to the dehumidified air outlet 113 and the purifier assembly 30 is arranged corresponding to the purified air outlet 115. A part of air entering the housing 10 from the air inlet 111 can be dehumidified by the dehumidifier assembly 50 before being changed into dry air and discharged from the dehumidified air outlet 113. The other part of air entering the housing 10 from the air inlet 111 can be purified by the purifier assembly 30 before being changed into clean air and discharged from the purified air outlet 115. Thus dehumidification and the air purification can be achieved by the purification dehumidifier 100. That is, the purification dehumidifier 100 with dehumidification and purification functions is provided.

Figure 3:
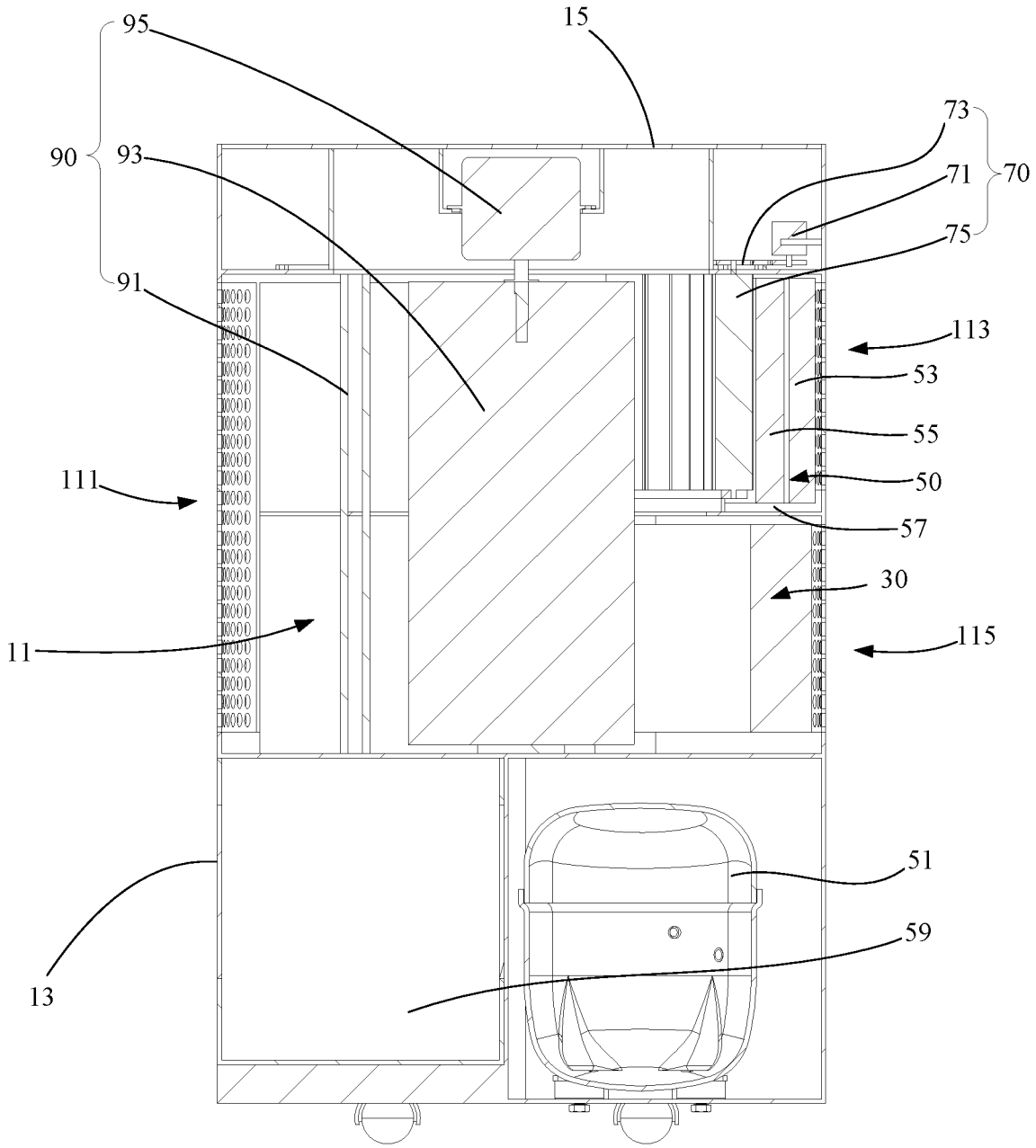
FIG. 3 is a cross sectional view of the purification dehumidifier of FIG. 2 taken along line A-A.
Figure 4:
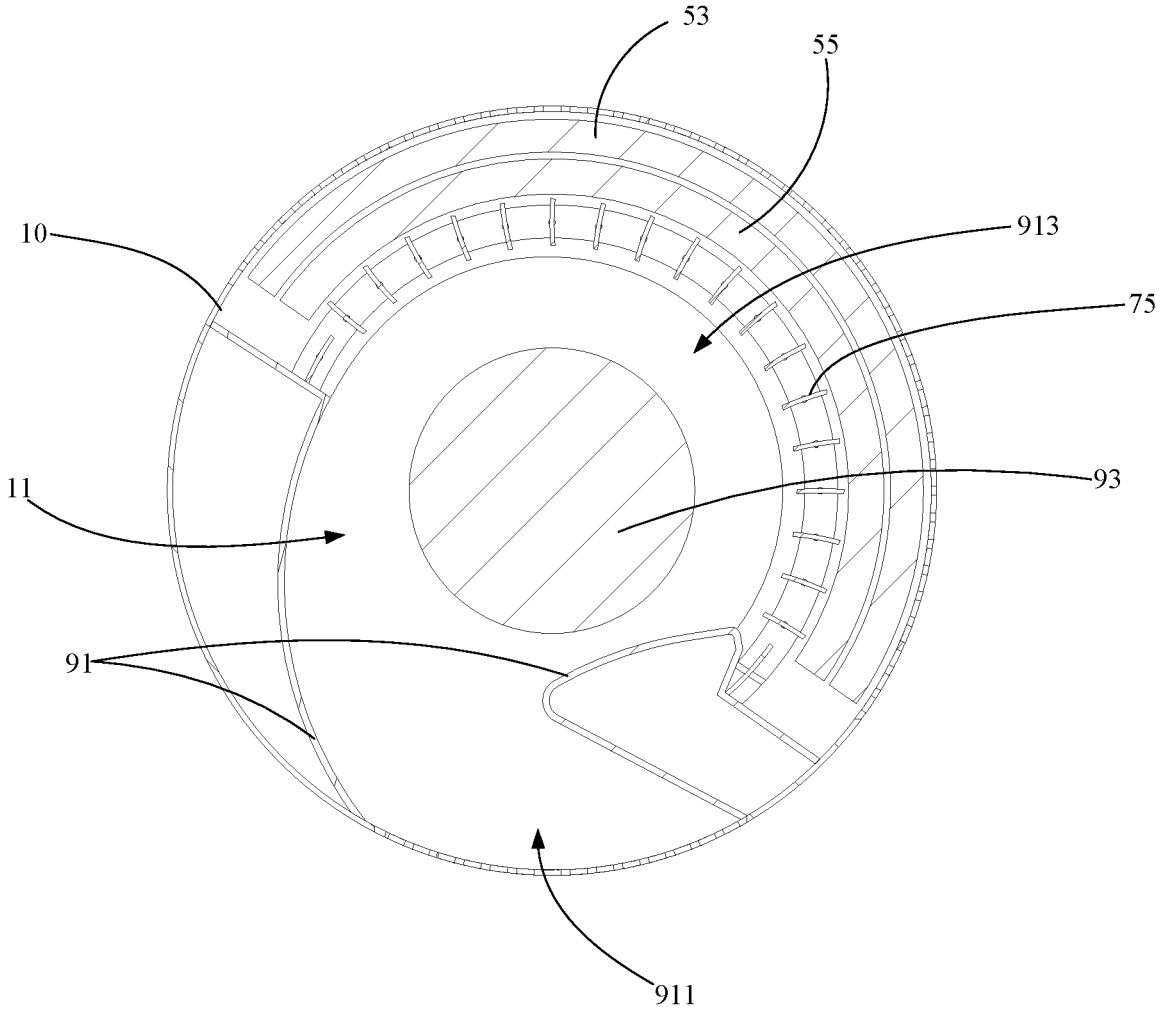
FIG. 4 is a cross sectional view of the purification dehumidifier of FIG. 2 taken along line B-B.

As shown in FIGS. 3 and 4, the purification dehumidifier 100 further includes an air door assembly which is disposed in the housing 10 and corresponds to the dehumidified air outlet 113 or the purified air outlet 115, configured to open or close the dehumidified air outlet 113 and/or the purified air outlet 115. It can be appreciated that the air door assembly can open or close the purified air outlet 115 or the dehumidified air outlet 113, and control an air outlet mode of the purification dehumidifier 100.

For example, a separate purification and/or a separate dehumidification may be provided. When air purification is needed, the purified air outlet 115 is opened through the air door assembly, and the dehumidified air outlet 113 is closed. The fan 90 starts and external air enters through the air inlet 111. Dust particles and impurities in the air are filtered through the purifier assembly 30, and then the air flow out through the purified air outlet 115, to complete the purification. When air dehumidification is needed, the dehumidified air outlet 113 is opened through the air door assembly, and the purified air outlet 115 is closed. The fan 90 starts, and external air enters through the air inlet 111, is dehumidified through the dehumidifier assembly 50, and then flows out through the dehumidified air outlet 113, to complete the dehumidification. When the purification and dehumidification are simultaneously needed, both the purified air outlet 115 and the dehumidified air outlet 113 are opened through the air door assembly, and outside air enters the air duct 11 through the air inlet 111 for purification and dehumidification, and then flows out through the purified air outlet 115 and the dehumidified air outlet 113.

Further, the air door assembly includes at least one air door structure 70 corresponding to the dehumidified air outlet 113 or the purified air outlet 115.

The air door structure 70 includes a driving member 71, a connection member 73 and at least two swing blades 75. The connection member 73 is connected with the driving member 71 and the swing blades 75. The driving member 71 is configured to drive the connection member 73 to move and drive the swing blades 75 to rotate. A gap may be formed between two adjacent swing blades 75 to open the dehumidified air outlet 113 or the purified air outlet 115; or, the two adjacent swing blades 75 abut each other to block the dehumidified air outlet 113 or the purified air outlet 115.

When the purified air outlet 115 and the dehumidified air outlet 113 are opened or closed, the air door structure 70 is correspondingly adopted. The driving member 71 drives the connection member 73 and drives the swing blades 75 to rotate, so that gaps are formed between adjacent swing blades 75, and air enters the air duct 11 from the gaps; or two adjacent swing blades 75 abut each other to block the path of air entering the air duct 11. As such, the air door structure 70 is relatively simple in nature, and the purified air outlet 115 and the dehumidified air outlet 113 can be opened or closed conveniently and quickly. In some embodiments, the purified air outlet 115 and the dehumidified air outlet 113 each correspond to one air door structure 70. The effect of independently opening or closing the purified air outlet 115 and the dehumidified air outlet 113 can be realized.

The air door structure 70 includes a plurality of swing blades 75 arranged in the housing 10, and each swing blade 75 is elongated and extends in the vertical direction. A plurality of swing blades 75 are arranged along the circumferential direction of the housing 10, and each adjacent two swing blades 75 can form an arc-shaped door body structure after being spliced, with no gap along the circumferential direction of the door body structure. In addition, both ends of the door structure are respectively provided with an annular partition 131. The upper end of the cylindrical structure abuts against the inner edge of the annular partition 131 located above, and the lower end of the door structure abuts against the inner edge of the annular partition 131 located below. When the driving member 71 drives each swing blade 75 to rotate, each adjacent two swing blades 75 are separated from each other to form a gap. The corresponding purified air outlet 115 and/or dehumidified air outlet 113 are in communication with the air duct 11 in the door body structure, and air can enter the air duct 11 through the purified air outlet 115 and/or dehumidified air outlet 113.

The air door assembly may include an air door structure 70 disposed corresponding to the dehumidified air outlet 113. As such, the air outlet modes of the purification dehumidifier 100 can include a combined mode with dehumidification and purification and a separate purification mode. Of course, the air door structure 70 can be arranged corresponding to the purified air outlet 115. As such, the air outlet modes of the purification dehumidifier 100 can include a combined mode with dehumidification and purification, and a separate dehumidification mode. In some embodiments, the air door assembly comprises two air door structures 70. One air door structure 70 is arranged corresponding to the dehumidified air outlet 113 and the other air door structure 70 is arranged corresponding to the purified air outlet 115. As such, the air outlet modes of the purification dehumidifier 100 can include a combined mode with dehumidification and purification, a separate dehumidification mode, and a separate purification mode.

Figure 6:
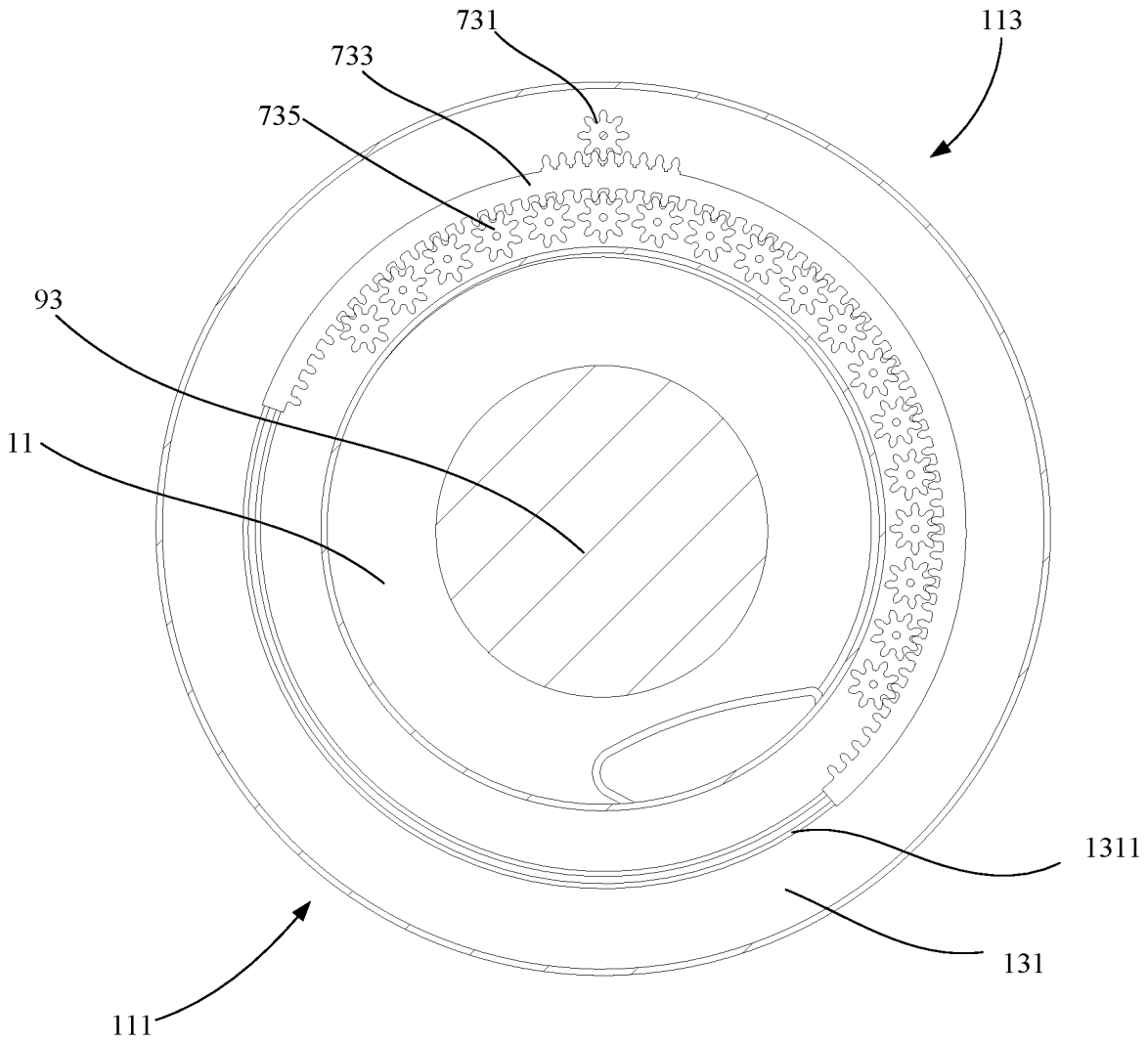
FIG. 6 is a cross sectional view of the purification dehumidifier of FIG. 2 taken along line D-D.

As shown in FIG. 6, the connection member 73 includes: a first gear 731 connected to the driving member 71, a rack 733 meshed with the first gear 731, and at least two second gears 735 meshed with the gear rack 733. Each of the second gears is connected to one end of one of the swing blades 75. The driving member 71 is configured to drive the first gear 731 to rotate, the first gear 731 is configured to drive the gear rack 733 to move, the gear rack 733 is configured to drive each of the second gears 735 to rotate, and each of the second gears 735 is configured to rotate to drive one of the swing blades 75 to rotate.

The inner wall of the housing 10 is provided with an annular partition 131, which can be provided with an arc-shaped slide rail 1311. Correspondingly, the gear rack 733 is also arranged in an arc shape, matching the arc-shaped slide rail 1311. The gear rack 733 is mounted on the arc-shaped slide rail 1311, and can relatively slide along the arc-shaped slide rail 1311. In addition, the inner teeth of the arc-shaped rack 733 are meshed with each second gear 735. Each second gear 735 is sleeved on the rotating shaft of a swing blade 75. Additionally, the outer teeth of the arc-shaped rack 733 are meshed with the first gear 731, and the first gear 731 is sleeved on the output shaft of the first drive motor 95.

When the driving member 71 operates, its output shaft drives the first gear 731 to rotate. The rotation of the first gear 731 drives the gear rack 733 to slide along the slide rail 1311. The sliding of the gear rack 733 drives each second gear 735 to rotate. The rotation of each second gear 735 drives one swing blade 75 to rotate, realizing splicing or separating of each adjacent two swing blades 75. As such, the synchronous rotation of the swing blades 75 is effectively realized, and the structure is simple and practical.

Further, a guiding inclined surface is provided at the joint of one swing blade 75 and the other adjacent swing blade 75.

As such, the guiding and buffering of the guiding inclined surface can not only reduce the wear at the joint of each adjacent two swing blades 75 and prolong the service life of the swing blades 75, but also improve the sealing effect at the joint of each adjacent two swing blades 75 by abutting the two guiding inclined surfaces and avoid air leakage.

The driving member 71 is a step motor. As the precision of each step of the step motor is between 3% and 5%, the error of one step will not accumulate to the next. The step motor has advanced position precision and movement repeatability.

Figure 5:
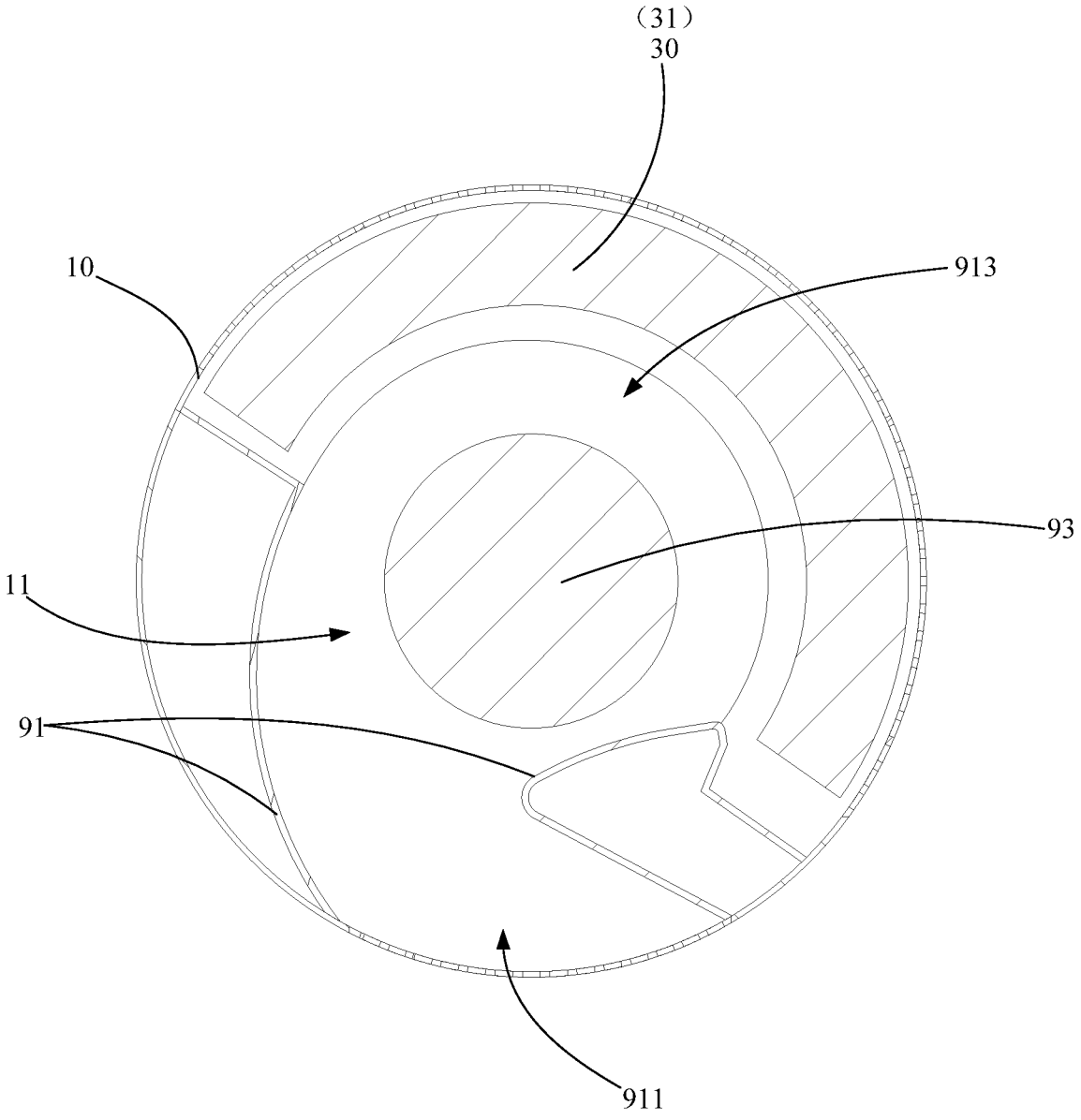
FIG. 5 is a cross sectional view of the purification dehumidifier of FIG. 2 taken along line C-C.

As shown in FIGS. 3 to 5, the fan 90 is a cross-flow fan.

Specifically, the cross-flow fan includes a volute 91, an impeller 93 arranged in the volute 91, and a motor 95 driving the impeller 93 to rotate. The volute 91 is positioned in the housing 10 and fixed to the side wall of the housing 10. The motor 95 is fixed to the upper end of the housing 10. The volute 91 has an air inlet side 911 and an air outlet side 913. The air inlet side 911 is in communication with the air inlet 111, and the air outlet side 913 is in communication with the dehumidified air outlet 113 and the purified air outlet In addition, the impeller 93 is extended in the height direction of the housing 10, and the height of the air inlet 111 is matched with the height of the impeller 93.

As such, the air inlet area of the purification dehumidifier 100 can be effectively increased and the air resistance can be reduced, thereby greatly improving the purifying and dehumidifying capability and the purifying and dehumidifying efficiency of the purification dehumidifier 100. And the purifying and dehumidifying effects of the purification dehumidifier 100 are further effectively enhanced. In addition, the application of the cross-flow fan can also enable the air intake of the purification dehumidifier 100 more uniform, thus improving the dehumidification effect of the dehumidifier assembly 50 and the purification effect of the purifier assembly 30. Additionally, the air flow flows through the impeller 93 with two times of force that that of the blades. The wind force on the air outlet side 913 of the volute 91 can be more stabilized, thus improving the dehumidification and purification. In addition, the application of cross-flow fan may produce relatively less noise.

Figure 2:
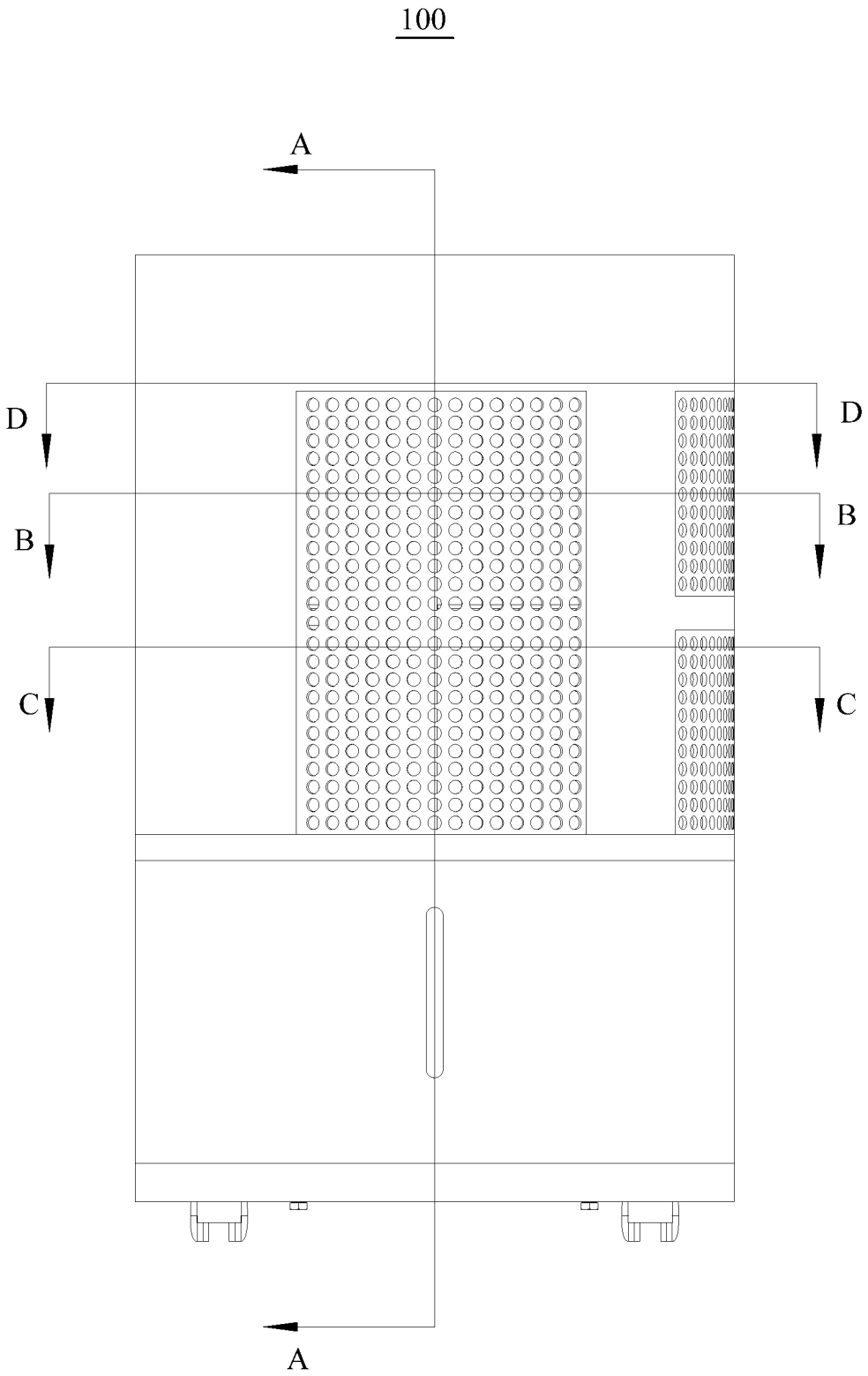
FIG. 2 is a front view of the purification dehumidifier of FIG. 1.

As shown in FIGS. 1 to 3, the dehumidified air outlet 113 and the purified air outlet 115 are spaced apart from each other in the height direction of the housing 10.

Specifically, the housing 10 includes a cylinder 13 and an end cap 15 that covers the upper end of the cylinder 13. The peripheral wall of the cylinder 13 is formed with an air inlet 111, a dehumidified air outlet 113, and a purified air outlet 115. In some embodiments, the air inlet 111, the dehumidified air outlet 113, and the purified air outlet 115 are all in a grid shape formed by a plurality of small circular holes distributed at intervals. The purified air outlet 115 is located above the dehumidified air outlet 113, both of which are opposite to the air inlet 111.

Understandably, since the dehumidified air outlet 113 and the purified air outlet 115 are arranged at interval in the height direction of the housing 10, the dehumidified air outlet 113 and the purified air outlet 115 can respectively occupy the side wall surfaces at different height positions of the housing 10, thereby being beneficial to increasing the dehumidified air outlet area and the purified air outlet area. It may also increase the volumes of the condenser 55, the evaporator 53 and the purification filter layer, further greatly improving the dehumidification and purification capacity and efficiency, and improving the dehumidification and purification effects.

Further, the air inlet 111, the dehumidified air outlet 113, and the purified air outlet 115 are all distributed along the circumferential direction of the housing 10.

Specifically, the air inlet 111, the dehumidified air outlet 113, and the purified air outlet 115 are all distributed along the circumferential direction of the cylinder 13. As such, the dehumidifier assembly 50 correspondingly includes a condenser 55 and an evaporator 53 which are in an arc shape. The condenser 55 and the evaporator 53 are sequentially provided along the air outlet direction of the dehumidified air outlet 113. As such, the evaporator 53 is positioned outside the condenser 55 and covers the dehumidified air outlet 113. The purifier assembly 30 includes a purification filter layer with an arc shape, which covers the purified air outlet 115.

It can be appreciated that when the fan 90 operates, under the drive of the fan 90, a part of the air in the purification dehumidifier 100 changes into dry air after passing through the arc-shaped condenser 55 and evaporator 53, and the dry air diffuses into the room from the dehumidified air outlet 113. The dehumidified air outlet 113 is distributed along the circumferential direction of the housing 10, not only effectively increasing the volume of the condenser 55 and evaporator 53, but improving the dehumidification capacity, dehumidification efficiency and dehumidification effect of the purification dehumidifier 100. And the air outlet area of the dehumidified air outlet 113 is also increased, so that dehumidified air can fill the room more quickly, further improving the dehumidification effect of the purification dehumidifier 100. Additionally, another part of the air in the purification dehumidifier 100 is changed into clean air by the purified air outlet 115 after being acted by the arc shape purifying filter layer and diffused into the room. As such, the purified air outlet 115 is distributed along the circumferential direction of the housing 10, not only effectively increasing the volume of the purifying filter layer, but also improving the purifying capacity, the purifying efficiency and the purifying effect of the purification dehumidifier 100. The air outlet area of the purified air outlet 115 is also increased, and the purified air can fill the room more quickly, thereby further improving the purifying effect of the purification dehumidifier 100. In addition, the air inlet 111 being distributed along the circumferential direction of the housing 10 can further increase the air inlet area and reduce the air resistance, thereby further improving the purification and dehumidification capability of the purification dehumidifier 100 and improving its purification and dehumidification efficiency.

In addition, it can be appreciated that in other embodiments, the housing 10 can also be provided as a cavity structure with an oval or polygonal cross section.

Further, the purification filter layer includes an activated carbon filter layer and a high-efficiency air filter layer, which are sequentially provided along the air outlet direction of the purified air outlet 115. As such, the air blown out from the purified air outlet 115 can pass through the activated carbon filter layer and the high-efficiency air filter layer successively before being blown out, effectively improving the air purification effect.

It should be appreciated that, the activated carbon filter layer can utilize porous activated carbon to adsorb one or more substances in the air on its surface and remove them. The removed objects include soluble organic substances, microorganisms, viruses and a certain amount of heavy metals. It may also decolorize, deodorize and purify the air. The activated carbon lattice can form developed pores with different shapes and sizes, thus greatly increasing the specific surface area and improving the adsorption capacity.

High efficiency particulate air filter (HEPA) is mainly used to collect dust particles and various suspended substances smaller than 0.5 micrometer. The filter layer of the high efficiency air filter is featured that air can pass through, but fine particles is blocked. Its count transmittance for particles with particle diameter ≥0.1 micrometer is ≤0.001% (i.e., efficiency ≥99.999%), and it is the most effective filter medium for pollutants such as smoke, dust and bacteria. The filter layer of the high-efficiency air filter can be a PP filter paper, a glass fiber, a composite PP-PET filter paper, a meltblown polyester nonwoven fabric or a meltblown glass fiber, etc.

Therefore, through the filtration of the active carbon filter layer and the high-efficiency air filter layer, organic pollutants and particles in the air can be purified, thus improving the purification effect and the air quality.

It should be appreciated that the shape, size and arrangement of the condenser 55 and the evaporator 53 can match those of the dehumidified air outlet 113 to achieve the optimal dehumidification effect. Additionally, the shape, size and arrangement of the purification filter layer can match those of the purified air outlet 115 to achieve the optimal purification effect. In addition, both the condenser 55 and the evaporator 53 can be provided with a plurality of heat exchange fins to increase the heat exchange area and improve the heat exchange efficiency.

Referring further to FIG. 3, the dehumidifier assembly 50 further includes a water tank 59 and a water receiving tray 57 disposed in the housing 10. The water receiving tray 57 is located below the evaporator 53 and is in communication with the water tank 59. By arranging the water receiving tray 57 below the evaporator 53, the water receiving tray 57 can receive the condensed water flowing down from the surface of the evaporator 53, and by communicating the water receiving tray 57 with the water tank 59, the condensed water can be better guided into the water tank 59 for collection. The leakage or overflow of the condensed water can be thus avoid causing adverse effects on the internal circuit of the purification dehumidifier 100. In addition, the water tank 59 may also be provided with a liquid level detection device, which is connected with the main controller of the purification dehumidifier 100. When the liquid level detection device detects that the water level in the water tank 59 reaches a preset threshold, it transmits an alarm signal to the main controller, and the main controller sends out a prompt tone or message. As such, the user can be reminded of draining the water flow in the water tank 59. The water flow in the water tank 59 can be drained in two ways: one way is to arrange a water outlet pipe on which a valve is arranged to control the outflow of water. The other option is that the housing 10 is provided with an avoiding opening, the avoiding opening is provided with a movable door 17, and the water tank 59 is arranged in the housing 10 and corresponding to the avoiding opening. By opening the movable door 17, the water tank 59 is taken out from the avoiding opening, and the water is poured out.

Further, the compressor 51 is located below the condenser 55 and the evaporator 53, and provided opposite to the water tank 59. The compressor 51 is arranged below the condenser 55 and the evaporator 53 to facilitate the communication of pipelines. Since both the water tank 59 and the compressor 51 are heavy components, the installation of the purification dehumidifier 100 can be more stable by arranging both the water tank 59 and the compressor 51 at the lower end of the housing 10. Additionally, arranging the water tank 59 opposite to the compressor 51 can save the arrangement space inside the housing 10, so that the overall structural layout of the purification dehumidifier 100 is more compact.

The purification dehumidifier 100 may further include a first air door assembly (not shown) and a second air door assembly (not shown), where the first air door assembly is provided corresponding to the purified air outlet 115 to open or close the air flow passage at the purified air outlet 115, while the second air door assembly is provided corresponding to the dehumidified air outlet 113 to open or close the air flow passage at the dehumidified air outlet 113. In addition, the purification dehumidifier 100 may also be provided with an air quality monitoring device, including a particle sensor, a humidity sensor, etc. The air quality monitoring device is electrically connected with the main controller, and when more dust in the air is detected, the main controller controls the first air door assembly to open the airflow channel at the purified air outlet 115 to purify indoor air. When the humidity in the air is detected high, the main controller controls the second air door assembly to open the air flow passage at the dehumidified air outlet 113 to dehumidify the air indoor. Of course, when more dust and moisture are simultaneously detected, the main controller controls the two air door assemblies to open the air flow passages at the purified air outlet 115 and the dehumidified air outlet 113 respectively to purify and dehumidify the air.

It can be appreciated that the purification dehumidifier 100 can also be a part of the smart home Internet of Things. For example, the purification dehumidifier 100 is provided with a signal transmission device which is wirelessly connected with a mobile terminal (e.g., smart phone, tablet computer, etc.), and the wireless connection mode can be WiFi, Bluetooth, infrared or 4G. Through the signal transmission device, the mobile terminal can receive monitoring data and working status of the purification dehumidifier 100. The mobile terminal can control the operation mode of the purification dehumidifier 100, and additionally, the purification dehumidifier 100 can also form an air quality report and send it to the mobile terminal for users to check.

The above are only some embodiments of the present disclosure and do not therefore constitute a limitation to the present disclosure. Any equivalent structure modification perceived by using the contents of the present specification and drawings, or directly or indirectly applied in other related technical fields, shall be included in the scope of the present application.

What is claimed is:

1. A purification dehumidifier comprising:

a housing including an air inlet, a dehumidified air outlet, and a purified air outlet, an air duct being formed in the housing, the air inlet, the dehumidified air outlet, the purified air outlet being in communication with each other via the air duct, the air inlet, the dehumidified air outlet, and the purified air outlet being all arranged on a side wall of the housing, and the dehumidified air outlet and the purified air outlet being arranged separately;

a fan arranged in the air duct and configured to introduce an airflow into the air duct from the air inlet and blow the airflow in the air duct out from at least one of the dehumidified air outlet or the purified air outlet;

an air door assembly arranged in the housing and corresponding to at least one of the dehumidified air outlet or the purified air outlet, and configured to open or block the at least one of the dehumidified air outlet or the purified air outlet, wherein along an air outflow direction, the air door assembly is arranged between the fan and the at least one of the dehumidified air outlet or the purified air outlet;

a dehumidifier assembly arranged in the air duct and corresponding to the dehumidified air outlet; and a purifier assembly arranged in the air duct and corresponding to the purified air outlet.

2. The purification dehumidifier of claim 1 wherein: the air door assembly includes an air door including a driving member, two swing blades, and a connection member connected with the driving member and the two swing blades; and the driving member is configured to drive the connection member to move to drive the two swing blades to rotate, so as to: form a gap between the two swing blades to open the at least one of the dehumidified air outlet or the purified air outlet; or allow the two swing blades to abut each other to block the at least one of the dehumidified air outlet or the purified air outlet.

3. The purification dehumidifier of claim 2, wherein: the connection member includes: a first gear connected to the driving member; a gear rack engaged with the first gear; and two second gears each being engaged with the gear rack and connected to one end of one of the two swing blades; the driving member is configured to drive the first gear to rotate; the first gear is configured to drive the gear rack to move; the gear rack is configured to drive the two second gears to rotate; and each of the two second gears is configured to drive a corresponding one of the two swing blades to rotate.

4. The purification dehumidifier of claim 2, wherein: one of the two swing blades includes a guiding inclined surface at a joint location to be sliced with another one of the two swing blades.

5. The purification dehumidifier of claim 3, wherein the driving member includes a step motor.

6. The purification dehumidifier of claim 1, wherein the fan includes a cross-flow fan.

7. The purification dehumidifier of claim 6, wherein:

the cross-flow fan includes a volute and an impeller arranged in the volute;

an air inlet side of the volute is in communication with the air inlet;

an air outlet side of the volute in communication with the at least one of the dehumidified air outlet and the purified air outlet.

8. The purification dehumidifier of claim 7, wherein:

the impeller extends along a height direction of the housing; and a height of the impeller matches a height of the air inlet.

9. The purification dehumidifier of claim 1, wherein the dehumidified air outlet and the purified air outlet are spaced apart from each other in a height direction of the housing.

10. The purification dehumidifier of claim 1, wherein the air inlet, the dehumidified air outlet, and the purified air outlet are arranged along a circumferential direction of the housing.

11. The purification dehumidifier of claim 1, wherein:

the dehumidifier assembly includes an evaporator and a condenser laminated along an air out-flowing direction of the dehumidified air outlet; and the evaporator covers the dehumidified air outlet.

12. The purification dehumidifier of claim 11, wherein the dehumidifier assembly further includes:

a water tank in the housing; and a water receiving tray in the housing, the water receiving tray being below the evaporator and in communication with the water tank.

13. The purification dehumidifier of claim 11, wherein the dehumidifier assembly further includes a compressor accommodated in the housing, the compressor being in communication with the evaporator and the condenser to form a refrigerant circulation loop.

14. The purification dehumidifier of claim 1, wherein the purifier assembly includes a purification filter layer covering the purified air outlet.

15. The purification dehumidifier of claim 14, wherein the purification filter layer includes an activated carbon filter layer and a high-efficiency air filter layer.

16. The purification dehumidifier of claim 1, wherein: the air door assembly including a driving member, two swing blades, and a connection member including: a first gear connected to the driving member; a gear rack engaged with the first gear; and two second gears each engaged with the gear rack and connected to one end of one of the two swing blades.

17. The purification dehumidifier of claim 16, wherein the two second gears are not engaged with each other.

18. The purification dehumidifier of claim 16, wherein:

the gear rack includes:

inner teeth on a first side of the gear rack; and outer teeth on a second side of the gear rack that is opposite to the first side;

the first gear is meshed with the outer teeth of the gear rack; and the two second gears are meshed with the inner teeth of the gear rack.

19. The purification dehumidifier of claim 1, wherein the dehumidified air outlet and the purified air outlet occupy side wall surfaces at different height positions of the side wall of the housing and are both opposite to the air inlet.

20. The purification dehumidifier of claim 1, wherein the air door assembly includes:

an air door including two swing blades rotatable to:

form a gap between the two swing blades to open the at least one of the dehumidified air outlet or the purified air outlet; and allow the two swing blades to abut each other to form an arc-shaped door body structure to block the at least one of the dehumidified air outlet or the purified air outlet.

* * * * *